US007658228B2

(12) United States Patent
Moksvold

(10) Patent No.: US 7,658,228 B2
(45) Date of Patent: Feb. 9, 2010

(54) HIGH PRESSURE SYSTEM

(75) Inventor: Harald Moksvold, Maura (NO)

(73) Assignee: Ocean Riser System, Oslo (NO)

( * ) Notice: Subject to any disclaimer, the term of this patent is extended or adjusted under 35 U.S.C. 154(b) by 470 days.

(21) Appl. No.: 11/375,061

(22) Filed: Mar. 15, 2006

(65) Prior Publication Data

US 2006/0219411 A1 Oct. 5, 2006

(51) Int. Cl.
*E21B 29/12* (2006.01)
*E21B 7/12* (2006.01)

(52) U.S. Cl. ..... 166/345; 166/355; 166/367; 175/5; 405/224.4

(58) Field of Classification Search ..... 166/345, 166/367, 350–355; 175/5–9; 405/224.2–224.4
See application file for complete search history.

(56) References Cited

U.S. PATENT DOCUMENTS 5,676,209 A 10/1997 Reynolds
5,706,897 A 1/1998 Horton
6,273,193 B1 8/2001 Hermann et al.

FOREIGN PATENT DOCUMENTS

| | | |
|---|---|---|
| GB | 2299355 | 10/1996 |
| WO | WO 98/58152 | 12/1998 |
| WO | WO 2005/100737 | 10/2005 |

*Primary Examiner*—Thomas A Beach
(74) *Attorney, Agent, or Firm*—Young & Thompson

(57) ABSTRACT

An arrangement and method for integrating a high pressure riser sleeve from the upper end of a high pressure drilling and workover riser terminated by an upper BOP close to sea level in one end and by a sub-sea blowout preventer BOP or a low riser package LRP close to the seabed in the lower end. The high pressure riser sleeve being installed, connected and integrated to the high pressure drilling and workover riser and extending up to and above the drill floor, inside a low pressure drilling riser slip joint which is connected to the drilling and workover riser. This relates to offshore drilling and well activities preformed from a floating drilling or workover rig or vessel. Operations can be switched from drilling with jointed drillpipe in a conventional manner, into performing underbalanced wireline and/or coiled tubing activities with full well pressure, much more effectively than with prior art.

17 Claims, 4 Drawing Sheets

HIGH PRESSURE SYSTEM

BACKGROUND OF THE INVENTION

1. Field of the Invention

The present invention relates to offshore drilling and well activities preformed from a floating drilling or workover rig or vessel.

2. Description of the Related Art

Today, when an offshore sub-sea well is intervened (work performed inside the production tubing below a sub-sea x-mas tree) from a floating vessel, a high pressure workover riser system is used. Such work-over riser systems has been designed with a subsea shut off valve (LRP) and/or a BOP configuration, close to the seabed and includes a riser disconnect package (RDP), to allow for a riser disconnect close to seabed when situations call for it. On the surface, the high pressure riser is terminated in a surface test tree (series of valves) above the rigfloor. To allow for riser tension, the drilling rig's main blocks for lowering and hoisting drillpipe is used to pull tension on the workover riser. Above the surface test tree, the pressure control equipment (surface BOP) for the well operations is installed, for lubricating into the well all of the work-over tools used in the operation.

Presently such systems are either designed for use in open water (stand alone), or the workover riser is run inside a 21" OD low pressure marine drilling riser system, which includes a 18 3/" inside diameter subsea drilling BOP installed on top of the sub-sea x-mas tree at seabed.

If the work-over system is being used inside a 21" drilling riser, the lower shutoff valves in the workover riser system close to seabed, are controlled independent of the drilling BOP on the outside and carry independent equipment for service of the well. To run all of this equipment is very time consuming, in that the rig crew first has to run the 21" marine drilling riser and the 18¾" drilling BOP and suspend this system in the drilling rig's riser tension system underneath the rig floor. Then the rig crew has to run the workover riser system inside the marine drilling riser all the way to seabed and suspend this riser to the outer drilling subsea BOP in the lower end and suspend this riser system in the rig's main drilling hook by help of an elevator or lifting frame in the upper end. In doing so, the main travelling blocks/hook is occupied and will prevent the rig from being able to run jointed pipe into the workover riser.

If the high pressure riser is run as a stand alone system in open waters, the subsea blowout preventer (BOP) and the riser disconnect package (RDP) is installed on top of the subsea x-mas tree. This riser system is to date not intended for use with jointed drillpipe but intended for extending the production tubing up to the drilling rig's work deck or rigfloor, so that wireline and coil tubing can be run into the well. This riser system is then hung off in the rig's drilling riser tensioning system and/or in the drilling hook with the help of an elevator or lifting frame. The surface BOP's for the workover riser system is then installed above the rig floor and above the elevator to the rigs main hoisting system. This will also prevent the rig from being able to run jointed drillpipe into the well, since the equipment for running jointed pipe is occupied holding tension in the riser system. Hence with prior art, it is not possible to change from running wireline or coiled tubing equipment into the well, into the process of running jointed drillpipe into the well or vice versa, without having to change out the whole riser system or disconnecting the riser from the production sub-sea x-mas tree.

U.S. Pat. No. 5,676,209 describes a low pressure drilling riser system which comprises 2 BOP stacks. The upper BOP stack is submerged below the wave affected area closer to sea level and the lower BOP placed at seabed. A marine drilling riser extending back to the drilling installation can be disconnected from the upper BOP stack so that the riser will be free standing in the ocean due to air-cans or flotation elements installed below and adjacent to the upper BOP. This riser system is fundamentally different from the high pressure drilling and workover riser specified in the present invention in that the riser specified in U.S. Pat. No. 5,676,209 is a low pressure riser with high pressure kill and choke lines running outside and parallel to the main drilling riser bore. This riser would not be able to tolerate high pressures from the well. In order to perform workover operations, a complete new workover riser would have to be installed inside this riser and extending down to the subsea BOP. Hence this prior art would not introduce any added benefits to the invention here described.

PCT publication WO98/58152 describes an apparatus and method for drilling sub sea wells. This apparatus has no BOP at seabed and describe an apparatus where the BOP stack is moved to higher location closer to the sea level. The system introduces large buoyancy elements or air cans which is required if the drilling riser connecting the BOP to the drilling rig has to be disconnected. A system of this nature as described in the publication, could not be connected to a sub-sea production x-mas tree and hence the production tubing for underbalanced workovers. Hence, this prior art is fundamentally different from this invention.

The Norwegian patents NO 306174 (H. Møksvold) and NO 305138 (S. Gleditsch) describes a high pressure drilling and workover riser which resembles the riser described in this invention. NO 305138 and NO 316174 describe a system where the workover coil tubing BOPs are integrated with the upper BOP which is terminated in the drilling and workover riser in the upper end. However in order to effectively be able to change between drilling with jointed drillpipe and underbalanced work with standard workover BOP equipment on a conventional drilling rig, with minimum of time used and without modifications, it will be necessary to introduce the high pressure riser extension sleeve described in this invention. The high pressure riser extension would allow for the coil tubing or wireline BOPs to be introduced only when needed and the integration process can be performed without having to disconnect the main workover riser from the sub-sea wellhead or sub-sea x-mas tree. These inventions wills hence save expensive rig time and/or prevent expensive equipment from being rigged up on top of the riser in the upper BOP when not needed.

The PCT WO 03/067023 A1 describe an arrangement and method for well completion and intervention operations where a workover riser projecting from a wellhead and up to a vessel is used, and where the upper portion of the workover riser is designed to be displaced from the upper position to a lowered position favourable for rigging work, where at least the upper displaceable portion of the workover riser essentially follows the heave motion of the vessel. This is a telescopic high pressure joint integrated with the main workover riser which is high pressure only when fully stroked out and put in tension by the rigs main hoisting equipment. This prior art is run inside a conventional drilling riser and extends all the way down to the seabed. In order to convert to drilling the whole workover riser including the sub-sea safety valves and control system for same, must be disconnected from seabed and pulled out of the well. In deeper waters this will take considerable amount of time. However integrating this prior art in the high pressure extension sleeve in this invention would allow for more easy rig-up of workover BOPs and tools on the drill floor. Time savings are hence only achieved by combining prior art with this new invention in this particular way and combination.

SUMMARY OF THE INVENTION

A specific embodiment of the invention, and variations thereof, will now be described by way of example with reference to the accompanying drawings.

The present invention specify the use of a high pressure workover and drilling riser with two BOP stacks (sub-sea and near surface), where the upper BOP (20) is placed below the rig floor (90) and is interfacing a conventional low pressure drilling riser (30) and/or slip joint (40) (41) as seen in FIG. 1. This figure also includes 1 conventional marine drilling riser (30) below the slip joint and where the whole riser system is being suspended by the rig's riser tensioning system (45), for placement of the upper BOP (20) below the wave affected zone near sea level. The purpose for this arrangement is to be able to drill with jointed drillpipe under more harsh weather conditions where rig heave need to be considered for the operation.

This invention specify the introduction of a short high pressure riser sleeve system (60) which is integrating the upper BOP (20) (inside the low pressure drilling slip joint (40) (41), which in combination with the high pressure riser system (10) described above, will make the change from running jointed drillpipe to allowing underbalanced operations with spooled equipment more effective and swift. Hence the high pressure riser sleeve can be run from the rig floor (90) down to the high pressure interface (25 in FIG. 3) above the upper BOP, thereby creating a HP conduit to the well. FIG. 3 describe the upper BOP (20) and how it integrates to the low pressure drilling riser (30) with high pressure chokelines (50) and killine (51) with the high pressure riser integration joint (60) inside and to the top of the high pressure riser (10) with a easy make up connector (21) to the high pressure riser (10). A system providing this option is novel art and has never been performed.

BRIEF DESCRIPTION OF THE DRAWINGS

The invention will be described in connection with the attached drawings, in which.

DETAILED DESCRIPTION OF THE PREFERRED EMBODIMENTS

Figure 1:
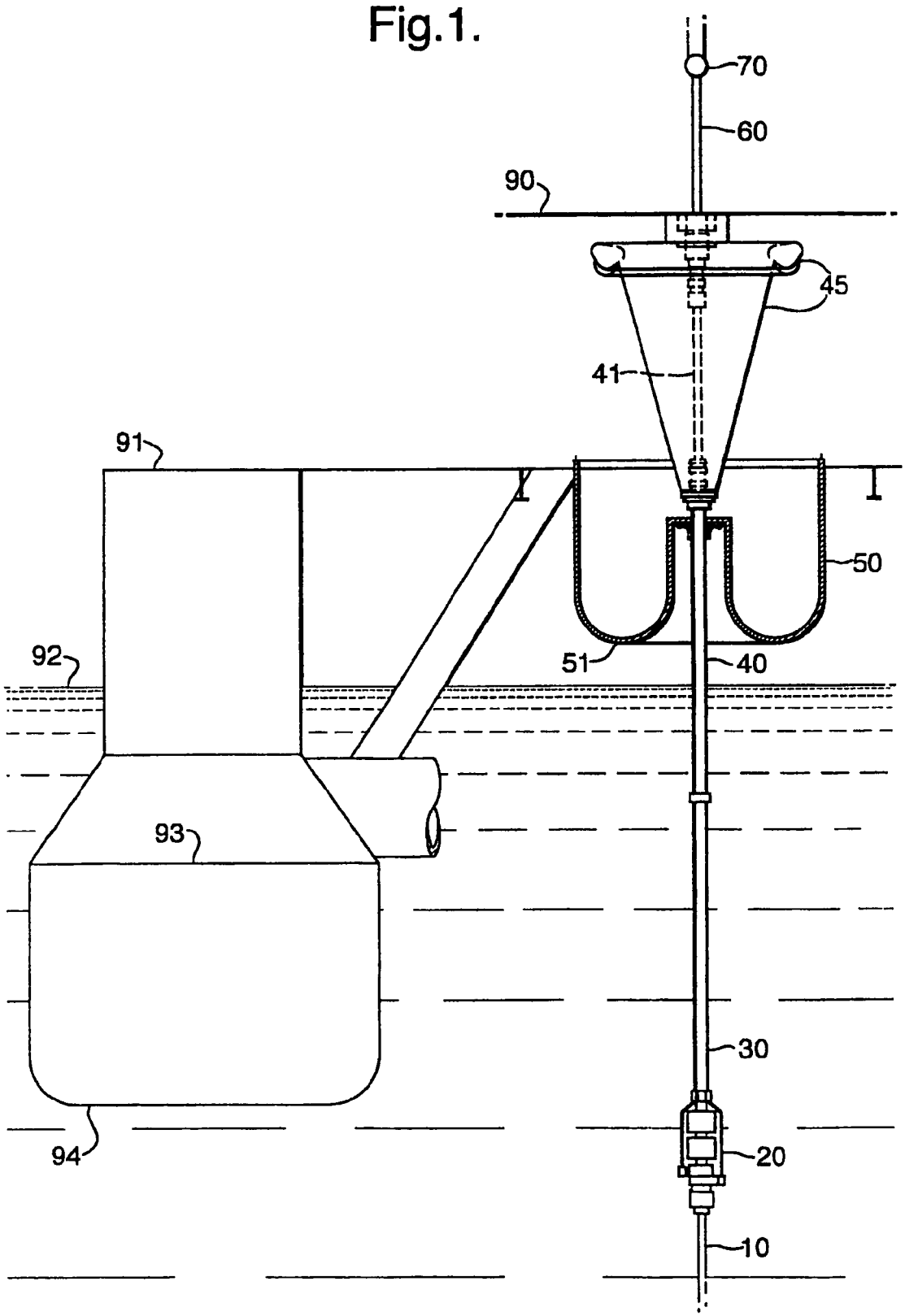
FIG. 1 is a simplified and partial elevation view of one leg of a semisubmersible drilling platform connected via a telescopic low pressure drilling riser to a subsurface BOP on top of a high pressure riser, with a high pressure sleeve according to the invention inserted through the telescopic low pressure drilling riser.

A system has been developed where the high pressure riser system carries one sub sea BOP stack including a riser disconnect package (RDP) directly above the sub sea BOP stack (not shown on the figure) with a high pressure riser (10) running back to surface, underneath the rigfloor (90). The high pressure riser is terminated in a surface BOP stack (20) above sea level (92)) at cellar deck level (91) which may require a special a special slip joint (80) in FIG. 2 or a sub surface BOP stack just below sea level (92) in FIG. 1. The differences between the surface BOP and the sub surface BOP is caused by the metocean conditions in the geographical areas where the rig is to be operated. The sub surface BOP stack (20) is arranged so that a normal low pressure drilling riser (30) is connected to the sub surface BOP stack (20) and the high pressure riser system (10). The position of the sub surface BOP stack is below Sea Level, and the purpose is to use the low pressure drilling riser with a large range/stroke slip joint (40) (41) to allow for more rig movements than a dry surface BOP stack where the heave limitation is dictated by the length of the low pressure telescopic section (80) which may be a special design above the surface BOP stack. This will prevent the upper BOP to be placed in the splash zone and hence be unaffected by waves in bad weather.

Figure 2:
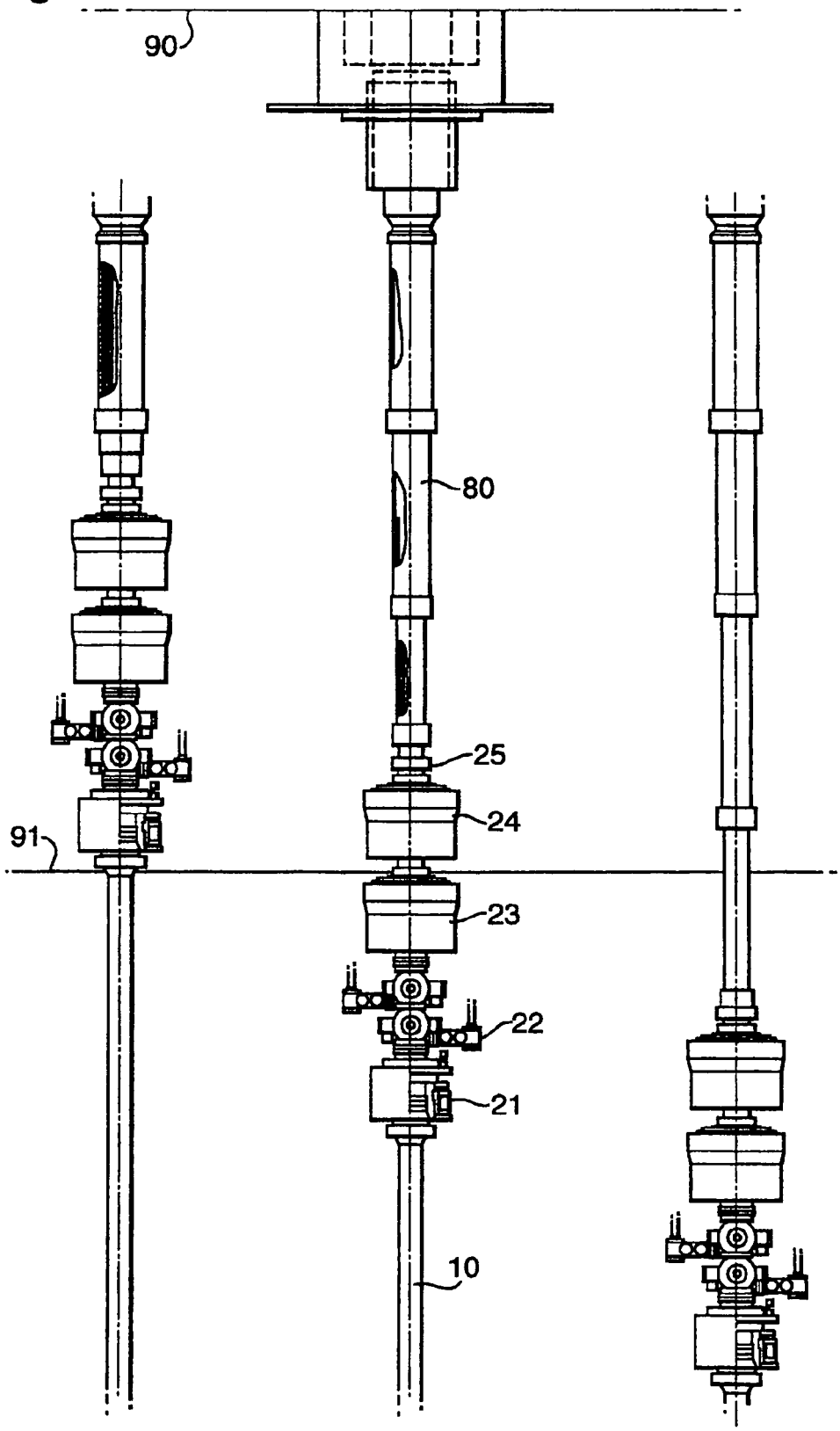
FIG. 2 illustrates three elevation views of a telescoping low pressure drilling riser connected to an upper BOP stack on a high pressure riser suspended from the drilling platform. The three elevation views illustrate different extensions of the telescoping low pressure drilling riser.
Figure 4:
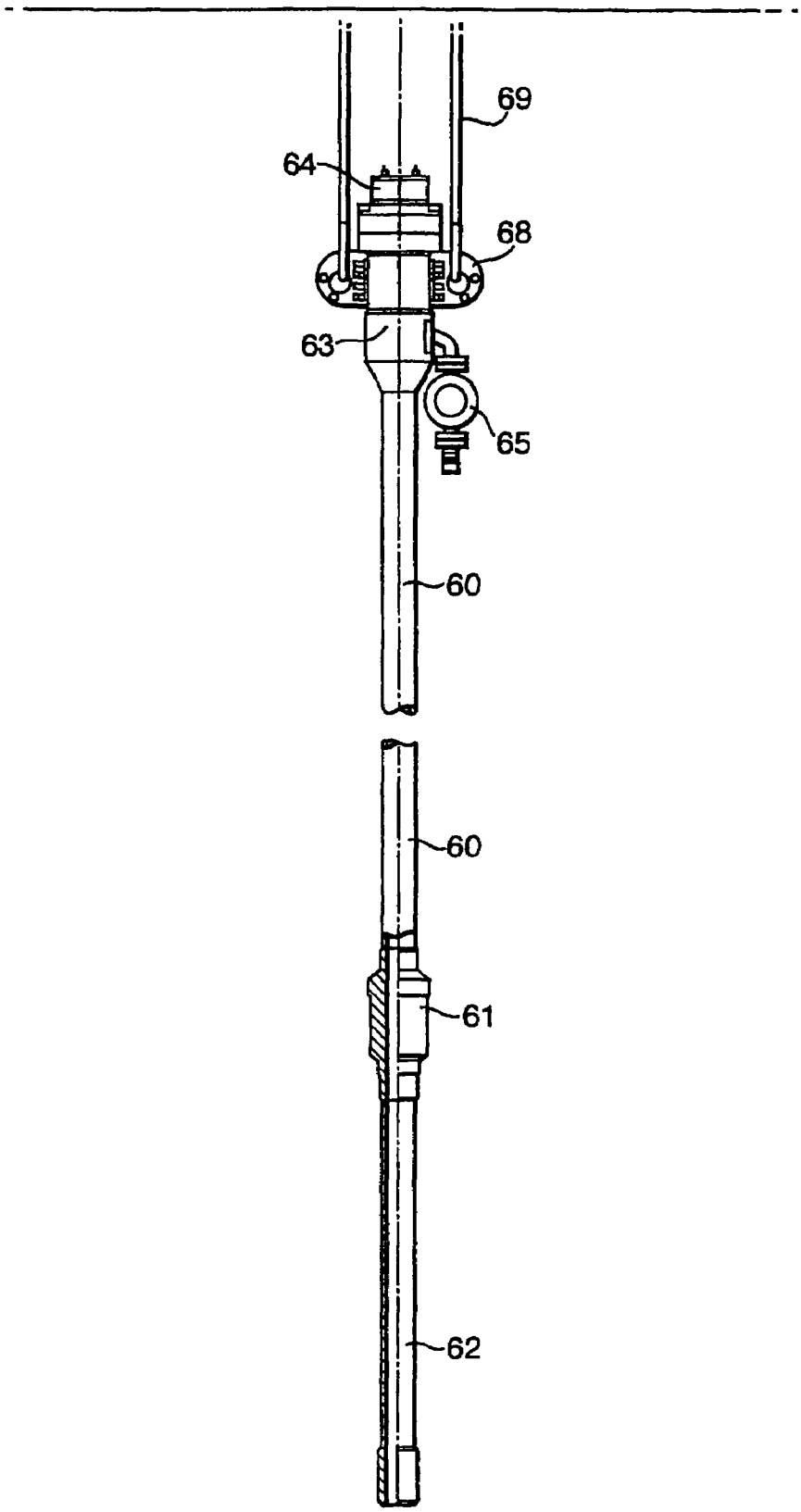
FIG. 4 is an elevation view of an upper portion of a high pressure sleeve according to the invention, and a partial elevation view, partial section view, of the lower portion of said high pressure sleeve.

The system specified in this invention includes both options of sub surface BOP stacks (FIG. 1) and surface BOP stacks in dry air (FIG. 2). Both these systems will need the high pressure riser sleeve (60 in FIG. 1) and described in detail in FIG. 4, to establish a high pressure connection between the top BOP stack (20) (sub- or surface BOP stack) and the required BOP equipment for the under-balanced work over operation. This operation may include wire line equipment such as wire line BOPs, or contain coiled tubing equipment such as BOPs and injector head. The top section of the riser sleeve will cater for interface to such equipment. The FIG. 4 shows the termination of the high pressure riser sleeve in that it allows for main hook elevator (68) to interface the high pressure riser sleeve in order to carry the weight of the workover BOPs and suspension (carry the weight of) for the HP riser sleeve.

The top BOP (surface/subsurface stack) (20) will carry rams which will be conditioned for the different tool strings the operation will require which can be seen in detail in FIG. 2. Further an annular BOP (23) and a rotating head (24) will be part of the BOP stack if required for the operation. The FIG. 2 explains a sub surface. BOP stack (20) carrying two ram type BOPs (22), one annular BOP (23) and one rotating head (24). The ram type BOP set up will require one set of blind rams to be used as shut off device similar to a lubricator valve to allow for quick bleed off for tool entry or removal from the high pressure riser system. This avoids well pressure back to the rig when working with the tool strings.

In addition an annular BOP is proposed in order to ensure a possibility for a secondary seal if the primary seals (61) in the bottom section of the sleeve should leak.

The system will have a separate high pressure sub-sea BOP (not shown) configuration onto the well head or the X-mas tree, with a high pressure connection to the production tubing or well. A high pressure riser (10) runs from the sub-sea BOP stack to the surface- or subsurface BOP stack (20) which forms the upper termination of the high pressure riser system (10).

In order to allow for the same heave limits as normal drilling risers of today with stroke of the telescopic riser joint (41) up to 65 ft. the subsurface BOP stack is suspended in a low pressure riser (30) including the telescopic joint (41, 40) and interface to the rig. This means that the high pressure riser (10) and BOP system (20) can be interfaced to any drilling rig without any major modifications to this part of the rig.

In order to allow for high pressure intervention without killing the well, the high pressure riser section to the rig floor is introduced. For normal well intervention purposes this sleeve will be terminated in a surface test tree (63 FIG. 4) or similar X over section on top, allowing for interfacing to wire-line equipment, coiled tubing equipment or other equipment required for entering a well under pressure.

The high pressure riser sleeve shall have an interface to the sub surface BOP stack (25) through a pressure tight seal (61) with an easy operated locking system, which can be a threaded connection (61) or a locking system carrying a locking sleeve design either through segments or other type of profiles (65). The connection shall carry seals (61) (65) to ensure a proper sealing method throughout the period the sleeve is in use. The top section is terminated in a crossover section (63) where the high pressure riser sleeve is suspended in an elevator (68) connected (69) to the hoisting machinery (hook and travelling blocks) in the derrick or tower. When the well is killed or in balance, the sleeve can be disconnected and removed to allow for direct access to the well through the rotary table with jointed pipe.

The purpose of using a high pressure riser sleeve like the one specified in this invention is to allow for high pressure access to the well from the drill floor (90).

The use of a sub surface BOP stack or a surface BOP (20) would only allow for high pressure integrity to the top of the upper BOP (20). By adding this high pressure riser sleeve (60), the high pressure system is extended up onto and above the drill floor (90).

The total length of the sleeve depends on the location of the upper BOP (20). If a surface BOP is used the low pressure riser section above the BOPs is short (80), if a sub surface BOP stack is used, the sleeve needs to comply with the distance from top of the high pressure BOP and up to drill floor.

Present technology and prior art would require a new riser system to be used or the high pressure riser sleeve would have to be run all the way down to the x-mas tree on seabed. Hence it is the combination of using a high pressure drilling riser with sub-sea and surface BOP and the high pressure sleeve which give the wanted effect.

Detail Description of Interface Between High Pressure Sleeve and HP Riser

Reference is made to FIG. 4. The high pressure sleeve consists of a bottom section (61) or (65) which interfaces the top of the sub surface BOP stack (25). The connection shall carry seals in order to seal off between the sleeve and the high pressure section of the upper BOP (20) to prevent well fluid to leak off into the low pressure riser system. In addition, the bottom section shall be locked down in order to keep the sleeve in a stationary position, independent of well pressure and pull performed by the top tension (elevators and main drilling hook).

Figure 3:
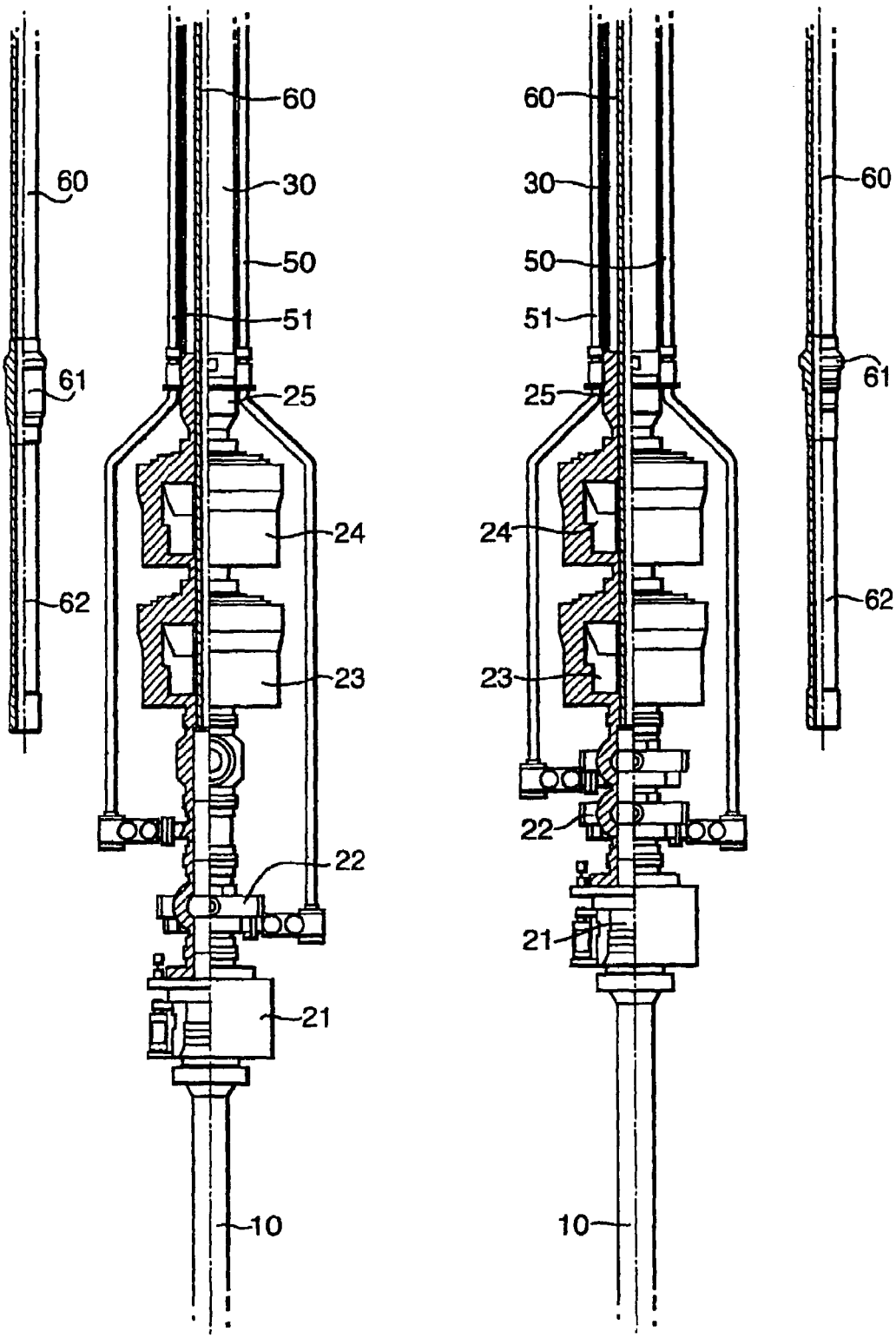
FIG. 3 illustrates in elevation view the upper portion of two high pressure risers and, in partial elevation and horizontal section view, alternative embodiments upper BOP stacks arranged on top of the high pressure risers and connected to the lower portions of low pressure drilling risers, and corresponding lower portions of high pressure sleeves for being threaded down into said low pressure drilling risers and locked into said upper BOP stacks.

The interface (25) to lock down the bottom section to the upper BOP stack (20) may be a threaded connection (61), "J" slot interface system or a latch mechanism (65), all performing the lock down function that is required. The FIG. 3 shows a threaded interface (61) and a latch type interface (25).

The seals described shall have the ability to seal off the between the bottom section and the top of the upper BOP. The sealing arrangement shall comply with the same pressure rating as the upper BOPs.

In addition or in stead of using the said seals, the bottom section can carry a sleeve below (62) that which can interfaces the sub surface BOPs (20). The shown sleeve extension in FIG. 3 (62) will interface the annular preventer (23) or the ram type BOP (22), which allows for the sealing capability as listed above or form a secondary seal in addition to the seals explained above.

The top interface of the bottom section (61) (65) shall interface the tube or sleeve running back to the drill floor (90) through the rotary table. This part consist of high pressure tubing (60) in compliance to tools run in the well and at the same time keep the pressure integrity as required for the well or having the same pressure rating as the upper BOP (20).

The top termination of the sleeve shall interface the surface test tree (63) or similar equipment as the X-over section to where the wire line BOPs or coiled tubing BOPs interface will be established (64). As an example, a simplified surface test tree (63) is shown with the elevator (68) interface to carry the suspension of the sleeve and the wire line BOPs or the coiled tubing equipment required for a well intervention.

To ease the installation operation of the tool strings etc. into the sleeve or well, a telescope section can be a part of the high pressure sleeve section. Such a telescopic section can be arranged so that it forms a part of the sleeve. Such telescopic system is prior art and is described in PCT WO 03/067023 A1. The purpose will be to collapse the section, when running tools in or out of the sleeve in order to avoid moving parts caused by rig movement while carrying out this operation. When in operation the telescope will need to follow the riser part in case any shut in of the well is required. This telescope is not shown in any of the drawings.

The invention claimed is:

1. A marine riser system comprising a wellhead comprising a riser disconnect package to a lower riser package with a lower blowout preventer, said lower riser package being connected to a lower end of a high pressure riser (10) extending from said lower riser package to a near-surface blowout preventer stack (20) arranged near the sea surface (92), said near-surface blowout preventer stack (20) being connected to a lower end of a low pressure drilling riser (30, 40) with a slip joint (80), said low pressure drilling riser (30, 40) extending from said near-surface blowout preventer stack (20) up to near a drill floor (90) of a vessel (93), said riser system further comprising a high pressure extension sleeve (60) in said low pressure drilling riser (30, 40) with a lower end (61, 62) of said low pressure drilling riser (30, 40) with a seal (61) being connected to a connector (25) on said near-surface blowout preventer (20), and a top end extending above said drill floor (90) and an upper end of said low pressure drilling riser (30, 40), a workover blowout preventer with a wireline or coiled tubing interface (64) at an upper end of said high pressure sleeve (60), said high pressure sleeve (60) being arranged for hanging in a main block (70) during wireline or coiled tubing operations, said seal (61) being disconnectable from said connector (25) of said near-surface blowout preventer stack (20) so that said high pressure extension sleeve can be pulled up from said low pressure riser (30, 40) after completion of wireline or coiled tubing operations.

2. The riser system of claim 1, wherein said near-surface blowout preventer stack (20) is arranged above the sea surface.

3. The riser system of claim 1, wherein said near-surface blowout preventer stack (20) is arranged below the sea surface.

4. The riser system of claim 1, wherein said near-surface blowout preventer stack (20) comprises an annular blowout preventer (23).

5. The riser system according to claim 1, wherein a production manifold is connected between said lower blowout preventer stack and said wellhead.

6. The riser system according to claim 1, wherein a lower portion of said high pressure extension sleeve (60) is provided with a sealing and locking arrangement adapted to be locked in a connector (25) in the top of said near surface blowout preventer stack (20).

7. The riser system according to claim 6, wherein said lower portion of said high pressure extension sleeve (60) is provided with a lower pipe portion below said sealing and locking arrangement, said lower pipe portion extending down through said annular blowout preventer (23) of said blowout preventer stack (20), for forming a secondary seal when said annular blowout preventer (23) is closed around said lower pipe portion.

8. The riser system according to claim 1, in which a telescopic joint is integrated in said high pressure extension sleeve.

9. A method for changing between a conventional through tubing drilling operation with a drill string from a vessel (93), to a wireline or coiled tubing operation, both operations being conducted through a marine riser system, comprising the steps of:

providing a riser system of a wellhead near the seabed, said wellhead comprising a riser disconnect package to a lower riser package with a lower blowout preventer, said lower riser package being connected to a lower end of a high pressure riser (10) extending from said lower riser package to a near-surface blowout preventer stack (20) arranged near the sea surface (92), said near-surface blowout preventer stack (20) being connected to a lower end of a low pressure drilling riser (30, 40) with a slip joint (80), said low pressure drilling riser (30, 40) extending from said near-surface blowout preventer stack (20) up to near a drill floor (90) of a vessel (93), drilling using a drill string through said riser system, said method further comprising removing said drill string from said riser system, lowering a high pressure extension sleeve (60) into said low pressure drilling riser (30, 40), and sealingly connecting a lower end (61, 62) of said high pressure extension sleeve (60) to said near-surface blowout preventer (20), a top end of said high pressure extension sleeve (60) extending above said drill floor (90), introducing wireline or coiled tubing through an interface (64) for such wireline or coiled tubing at a workover blowout preventer at an upper end of said high pressure sleeve (60), conducting a wireline or coiled tubing operation through the riser system, pulling said wireline or coiled tubing out of said riser system, said high pressure extension sleeve (60) and said workover blowout preventer with said interface (64), disconnecting said high pressure sleeve (60) from said near surface blowout preventer (20) and removing said high pressure sleeve (60) from said low-pressure riser (30, 40), and lowering a drill string through said riser system and resuming drilling operations.

10. The method of claim 9, further comprising arranging said near-surface blowout preventer stack (20) above the sea surface.

11. The method of claim 9, further comprising arranging said near-surface blowout preventer stack (20) below the sea surface.

12. The method of claim 9, further comprising providing an annular blowout preventer (23) in said near-surface blowout preventer stack (20).

13. The method of claim 9, further comprising providing a rotating head blowout preventer (24) in said near-surface blowout preventer stack (20).

14. The method of claim 1, further comprising connecting a production manifold between said lower blowout preventer stack and said wellhead.

15. The method of claim 9, further comprising locking a sealing and locking arrangement at a lower portion of said high pressure extension sleeve (60) to a connector (25) in the top of said near-surface blowout preventer stack (20).

16. The method of claim 15, further comprising extending a lower pipe portion below said sealing and locking arrangement below said high pressure extension sleeve (60) down through said annular blowout preventer (23) and closing said annular blowout preventer about said lower pipe portion (62) so as to form a secondary seal.

17. The method of claim 9, further comprising lowering a high pressure extension sleeve (60) into said low pressure drilling riser (30, 40) by means of a main hoisting equipment of said vessel (93).

* * * * *

UNITED STATES PATENT AND TRADEMARK OFFICE

CERTIFICATE OF CORRECTION

PATENT NO. : 7,658,228 B2
APPLICATION NO. : 11/375061
DATED : February 9, 2010
INVENTOR(S) : Harald Moksvold It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 801 days.

Signed and Sealed this

Twenty-eighth Day of December, 2010

David J. Kappos

David J. Kappos
*Director of the United States Patent and Trademark Office*